US005979949A

United States Patent [19]

Finkelstein et al.

[11] Patent Number: 5,979,949

[45] Date of Patent: Nov. 9, 1999

[54] SLIDING DOOR LATCH WITH LOCK-OUT PROTECTION

[75] Inventors: Burl Finkelstein; Stevie C. Roop, both of Newnan, Ga.

[73] Assignee: Kason Industries, Inc., Shenandoah, Ga.

[21] Appl. No.: 09/094,904

[22] Filed: Jun. 15, 1998

[51] Int. Cl.[6] ..... E05C 7/00

[52] U.S. Cl. ..... 292/29; 292/DIG. 46; 292/113; 292/126

[58] Field of Search ..... 292/26, 27, 29, 292/113, 118, 359, DIG. 46; 70/467, 468, 471, 481, 487, 488

[56] References Cited

U.S. PATENT DOCUMENTS

| | | | |
|---|---|---|---|
| 2,530,330 | 11/1950 | Groeger | 292/DIG. 46 |
| 2,540,686 | 2/1951 | Milburn | 292/DIG. 46 |
| 3,025,693 | 3/1962 | Braginetz | 292/DIG. 46 |
| 3,198,564 | 8/1965 | Welsh | 292/DIG. 46 |
| 3,670,536 | 6/1972 | Klebba | 70/99 |
| 4,126,340 | 11/1978 | Pelcin | 292/336.3 |
| 4,457,146 | 7/1984 | Weinerman | 292/216 |
| 4,511,166 | 4/1985 | Weinerman | 292/29 |
| 4,835,997 | 6/1989 | Akright | 292/216 |
| 5,141,266 | 8/1992 | Braun et al. | 292/216 |
| 5,221,115 | 6/1993 | Takimoto | 292/DIG. 46 |
| 5,526,659 | 6/1996 | Takimoto | 292/DIG. 46 |
| 5,540,066 | 7/1996 | Takimoto | 292/210 |
| 5,573,287 | 11/1996 | Takimoto | 292/DIG. 46 |

OTHER PUBLICATIONS

Kason Hardware Corporation, Latch, May 28, 1958, Blue print copy of the original drawing May 28, 1958, showing the 10 revisions through the years to Sep. 6, 1996.

Kason Hardware Corporation, 4000 Latch, Copy of the 4000 Latch p. 105, from Catalog 6.

Kason Hardware Corporation, 4000 Latch, Aug. 1979, Old condensed Catalog No. 50 dated Aug. 1979, 4000 Latch p. 2.

*Primary Examiner*—Flemming Saether
*Assistant Examiner*—Teri Pham
*Attorney, Agent, or Firm*—Kennedy, Davis & Hodge LLP

[57] ABSTRACT

A latch for a sliding door of a truck or the like comprises a housing, a latch bar mounted to the housing for pivotal movement and spring means biasing the latch bar towards a latched position. An outboard cam is rotatably mounted to the housing for camming engagement with the latch bar. An outside handle is mounted to the outboard cam. An inboard cam is rotatably mounted to the housing for camming engagement with the latch bar and an inside handle is mounted to the inboard cam. A lock slide is mounted for manual movement into and out of locking engagement with the outboard cam. A mechanism is also included for moving the lock slide when positioned in the locking position out of the locking position in response to pivotal movement of the latch bar.

1 Claim, 3 Drawing Sheets

SLIDING DOOR LATCH WITH LOCK-OUT PROTECTION

TECHNICAL FIELD

This invention relates generally to door latches, and particularly to latches for sliding doors such as those employed on trucks and vans.

BACKGROUND OF THE INVENTION

Package delivery trucks, which have also been referred to as panel trucks and vans, typically have one or more sliding doors. By gripping a door handle on the inside or outside, the door may be manually moved between positions closing and opening a doorway in the truck body. These doors typically have a latch coupled with the two handles which holds the door in a fully opened or fully closed position by engagement with strikes mounted adjacent each end of the door run above its track. The door in its closed position may thus be unlatched and slide open from either side of the door by rotation and pulling the inside or outside handle. For security these latches have also been provided with manually operable inside locks which prevent the door from being opened from the outside while a worker is inside. This has commonly been in the form of a lock bar that may be moved into and out of locking engagement with an internal cam that is operated by the outside handle that cams the latch out of latching engagement with a strike. Exemplifying such sliding door latches are those latches of the model 4000 series that have been sold for the past 30 years by Kason Industries, Inc. of Shenandoah, Georgia.

A persistent problem associated with these sliding door latches has been their propensity to lock out authorized users by accident. Too often a worker who has locked the latch while working inside the vehicle will forget to unlock it upon his departure. Once outside the vehicle the worker can slide the door shut, even using the outside handle, whereupon he or she is now unintentionally locked out.

Heretofore efforts to incorporate a lock self-cancelling feature into sliding door latches have been made but without practical, commercial success. These efforts have involved more costly designs with retrofit inability. Thus there has long existed a need for a sliding door latch with an inside lock that has means for automatically canceling or unlocking the latch lock upon the latch being operated over the strike after having locked. It is to the provision of such that the present invention is primarily directed.

SUMMARY OF THE INVENTION

In a preferred form of the invention, a latch for a sliding door of a truck or the like comprises a housing and a latch bar mounted to the housing for pivotal movement. Spring means bias the latch bar towards a latched position. An outboard cam is rotatably mounted to the housing for camming engagement with the latch bar. An outside handle is mounted to the outboard cam. An inboard cam is rotatably mounted to the housing also in camming engagement with the latch bar to which an inside handle is mounted for camming engagement with the latch bar. A lock slide is mounted for manual movement into and out of a position of locking engagement with the outboard cam. Means are provided for moving the lock slide if positioned in its locking position out of its locking position in response to movement of the latch bar.

With this construction any operative movement of the latch bar causes the latch lock to be moved to its unlocked position if not already there. Thus, if the latch bar has been manually moved into its locked position with the door latched open, latched closed, or unlatched with the door partially open, it will become unlocked whenever the door is latched closed. This serves to prevent a worker form becoming locked out unintentionally.

DETAILED DESCRIPTION

Figure 1:
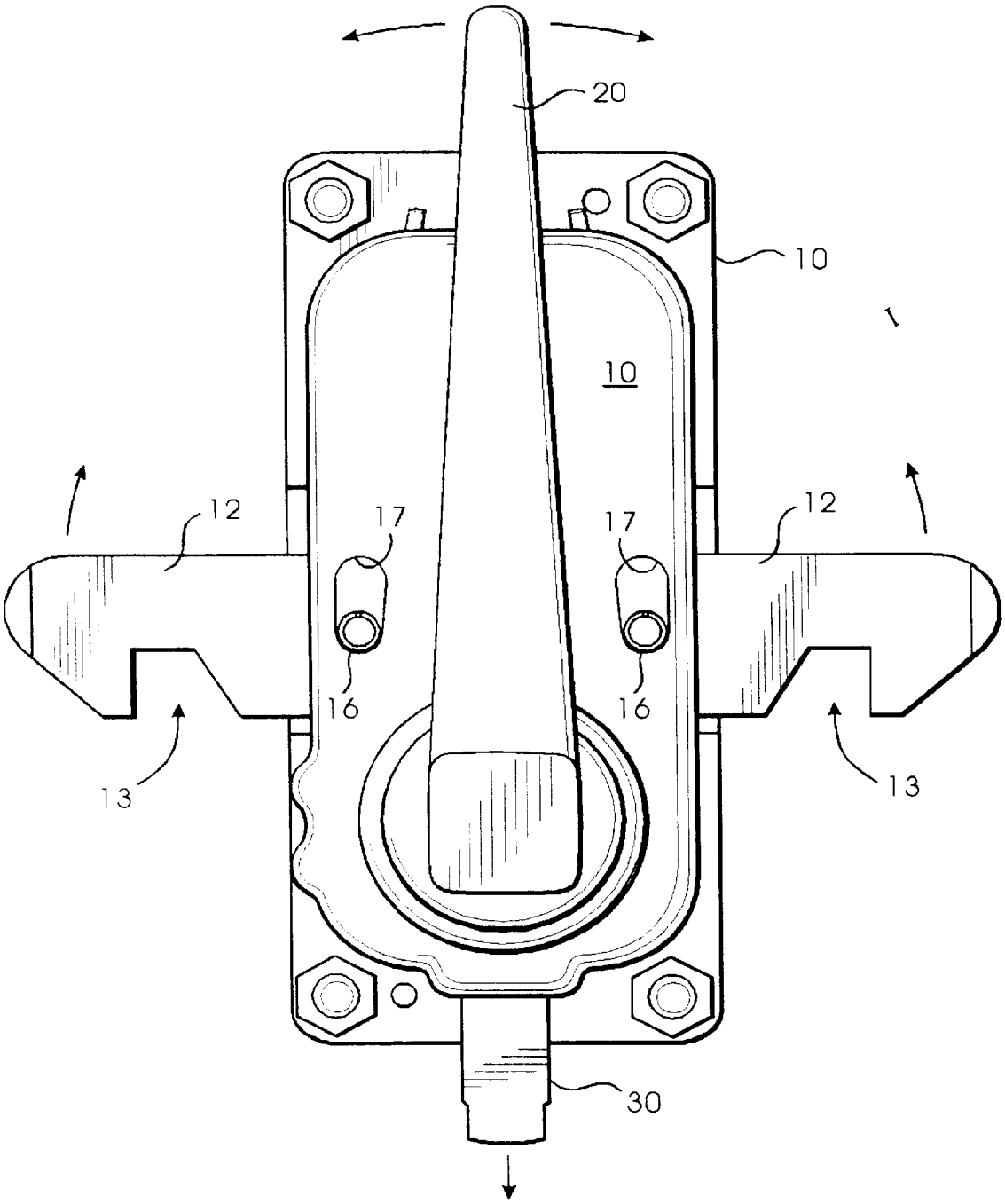
FIG. 1 is an inside face view of a preferred embodiment of the latch shown in a latch locked position.

With reference next in more detail to the drawing, there is shown a latch for a sliding door which comprises a housing 10 to which a latch bar 12 is pivotably mounted. The latch bar is seen to extend laterally through and to each side of the housing and to be formed with two catches 13 adjacent its two opposite ends. The latch bar is movably mounted to the housing by a center pin 14 that extends through a housing slot 15 and by two roll pins 16 that extend through two other slots 17 that straddle slot 15. Since all of these pins are smaller than their slots, the latch bar has some limited freedom of movement with respect to the housing. Two compression springs 18 are mounted to opposite sides of the center pin 14 and bias the latch bar 12 downwardly bringing those pins into contact with the bottom of the slots 15 and 17. Thus, the latch bar may be lifted slightly as well as rotated about the center pin a little as its beveled ends engage a strike in causing either end to be cammed upwardly in seating one of its catches 13 on a strike. The strikes, unshown here, are mounted to both sides of the track on which a sliding door equipped with the latch is mounted to run.

Figure 2:
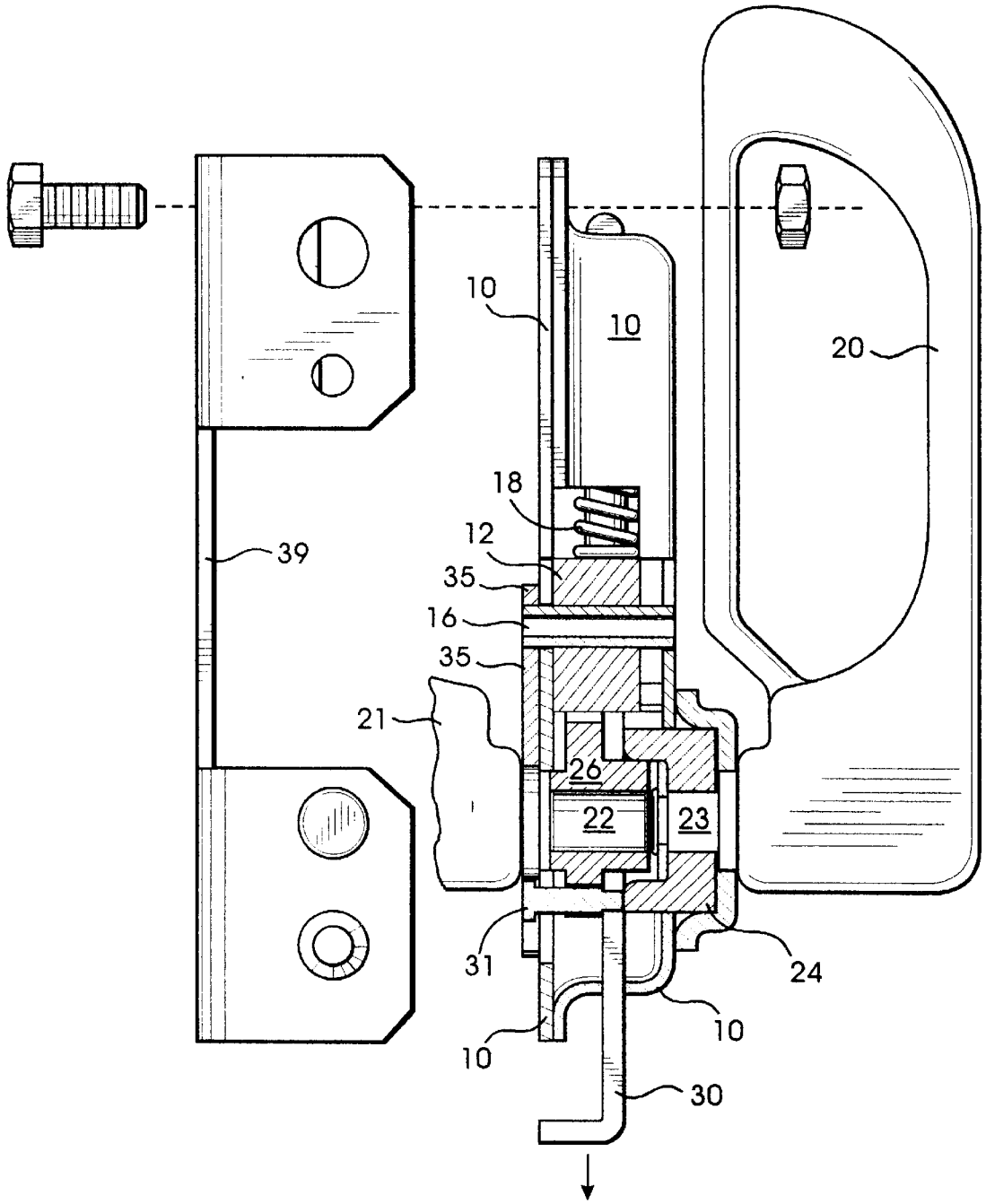
FIG. 2 is a side view, partly in cross-section through plane 2—2, of the latch shown in FIG. 3 together with a mounting bracket.

The latch is equipped with both an inside handle 20 and an outside handle 21 that is shown broken away in FIG. 2. Each of these handles are provided to lift the latch catch off of a strike in unlatching the door to which it is mounted. The inside handle 20 has a shaft 23 which is rigidly mounted to an inboard cam 24 that has a cylindrical portion journaled in a housing bearing. In FIG. 2 the cam is shown out of camming engagement with the bottom of the latch bar 12. However, clockwise or counterclockwise rotation of the handle 20 and the inboard cam 24 brings the cam into camming engagement with the latch bar to one side or the other of the center pin 14. This causes the latch bar to lift slightly and to cock or rotate against the biasing force exerted by the closer of the two compression springs 18. Similarly, manual operation of the largely unshown outside handle 21 and its shaft 22 causes an outboard cam 26 to which it is rigidly mounted to move into camming engagement with the latch bar independently of any operation of the inside handle 20.

Figure 3:
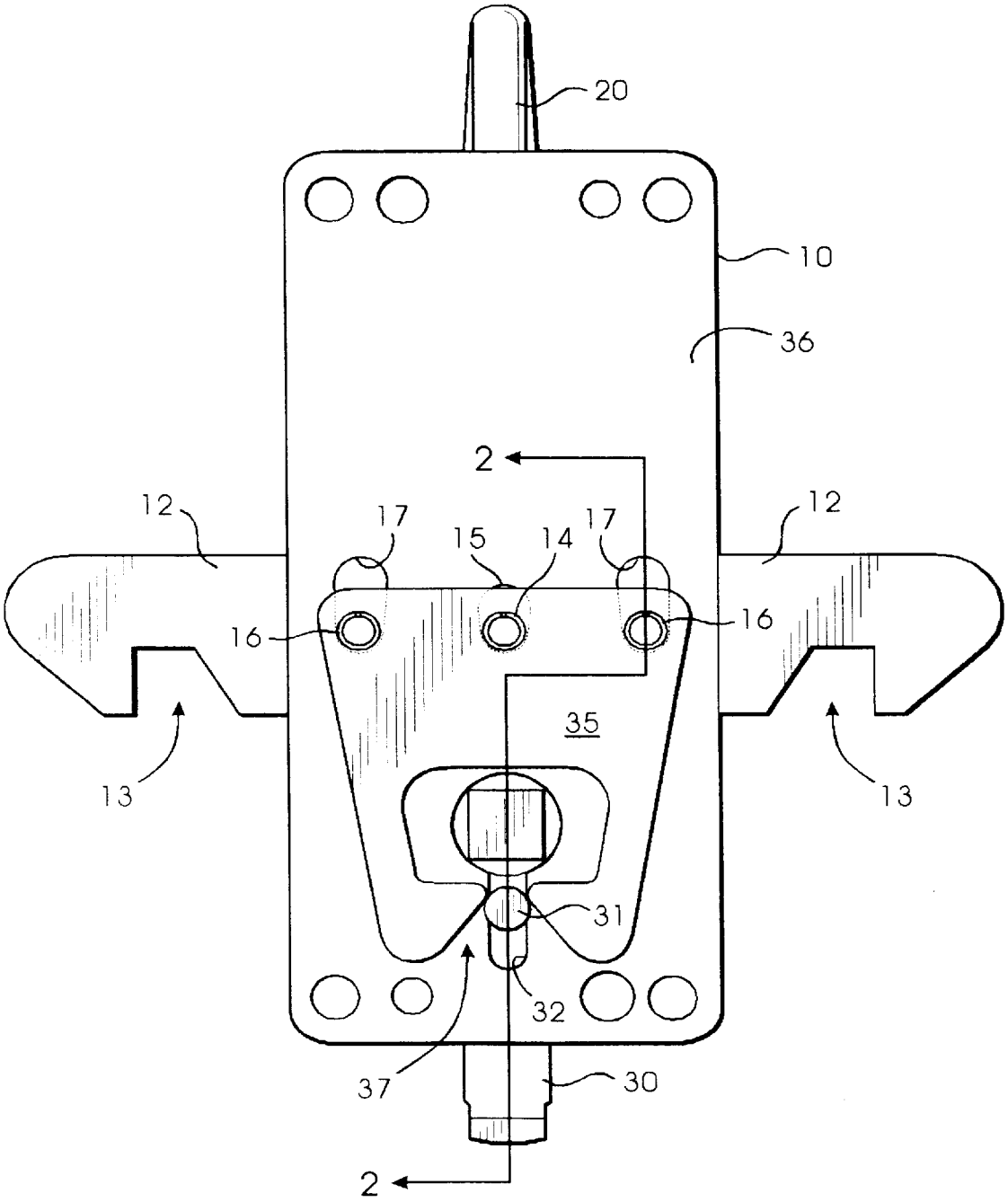
FIG. 3 is a rear face view of the latch shown in FIG. 1.

The latch is provided with means for manually locking the latch from the inside of a sliding door to which it is mounted to prevent the door from being unlatched from the outside. This locking feature is provided here by a lock bar or slide 30. The lock bar has a pin 31 that projects through a housing slot 32 that is shown in FIG. 3. The bar itself extends through a slot in the bottom of the housing and thus may be manually moved between its upper locked position shown in the drawing and a lower, unlocked position. The lock bar is mounted for reciprocal, vertical movement beside the inboard cam 24 into and out of a slot in the bottom of the outboard cam 26. In its up, locked position shown in the drawing, the lock bar, being partially positioned in the outboard cam slot, blocks the outboard cam from rotating. This renders the outside handle 21 useless in unlatching the latch until the lock bar 30 is manually pulled down from the inside. This can only be done of course if someone has access to it from the inside as the latch is mounted to the inside of a sliding door by a bracket 39 shown in FIG. 2.

The latch is further provided with an anti lock-out device in the form of a lock cancelling plate 35. The plate 35 is mounted to the center pin 14 for very limited rotary motion about it within a shallow recess in the back of the housing defined by a recess wall 36. The plate 35 has an inverted V-shaped channel 37 in its bottom. With the lock bar 30 in its raised, locked position shown in FIG. 3, its lock pin 31 engages the throat of the V-shaped channel of the plate 35. Should the latch bar 12 however rotate, which occurs when it becomes latched to a strike, one of the ramps that define the channel 37 of the cancellation plate 35 will cam the lock slide pin 31 down. This moves the lock slide 30 down and out of engagement with the outboard cam 26. With the lock slide disengaged from the outboard cam, the cam is free to be rotated by the outside handle 21 in unlatching the latch by lifting one side of the latch bar 12. Later, the lock slide may be again raised in locking the latch. Thus anytime the latch bar engages a strike, latching the door in its fully opened or fully closed position, the lock bar is by that action alone disengaged from its locked position should it be in that position. In this manner it provides the latch with an anti-lockout feature.

It thus is seen that a latch for a vehicle sliding door is now provided with an anti lock-out mechanism that serves to prevent one who has locked the latch from the inside and failed to unlock it upon departure from unintentionally being locked out of the vehicle. The mechanism is of simple yet reliable construction that may be readily retrofitted to existing latches without an increase in their size. It may of course be used on doors other than vehicle sliding doors. Indeed, while the latch with the anti lock-out device has been shown and described in its preferred form, many changes, additions and deletions may be made thereto without departure from the spirit and scope of the invention as set forth in the following claims.

We claim:

1. A latch for latching a sliding door at each end of its run and which comprises a housing adapted to be mounted to the door, a latch bar formed of a single piece and pivotally mounting to said housing that has catches located adjacent opposite ends thereof for releasible locking engagement with strikes that straddle the sliding door run, spring means biasing said latch bar towards a latching position, an outside handle mounted to one side of said latch bar in camming engagement with said latch bar, an inside handle mounted to a side of said latch bar opposite said one side in camming engagement with said latch bar, manually operable lock means for preventing said outside handle from camming said latch bar out of latch catch engagement with the strikes which includes a slide bar with a projecting pin and means responsive to movement of said latch bar out of latch catch engagement with either strike for moving said manually operating lock means to a position permitting camming operation of said latch bar by said outside handle which includes a lock bar disengaging plate rotatably supported on said latch bar in camming engagement with opposite sides of said slide bar projecting pin, and wherein said housing has two slots above and to opposite sides of said slide bar projecting pin, each of said slots having a slot end located distally said spring means, and wherein said latch bar is pivotally mounted to said housing by two roll pins that extend rigidly from said latch bar into said two housing slots whereby movement by the latch bar out of latch catch engagement with either strike is pivotal about the roll pin located distally the latch lifting strike.

* * * * *